US006918576B2

(12) United States Patent
Finkbeiner

(10) Patent No.: US 6,918,576 B2
(45) Date of Patent: Jul. 19, 2005

(54) LIFTING DEVICE FOR VEHICLES, ERECTING UNITS, MACHINES OR THE LIKE

(76) Inventor: Gerhard Finkbeiner, Kaseraenstrasse 6, D-72250, Freudenstadt (DE)

( * ) Notice: Subject to any disclaimer, the term of this patent is extended or adjusted under 35 U.S.C. 154(b) by 58 days.

(21) Appl. No.: 10/395,904

(22) Filed: Mar. 22, 2003

(65) Prior Publication Data

US 2003/0178610 A1 Sep. 25, 2003

(30) Foreign Application Priority Data

Mar. 25, 2002 (DE) ..... 102 13 308

(51) Int. Cl.[7] ..... B66F 7/12
(52) U.S. Cl. ..... 254/90
(58) Field of Search ..... 254/90, 88, 89 R, 254/894, 129, 122; 182/147, 151, 227, 153

(56) References Cited

U.S. PATENT DOCUMENTS 605,367 A * 9/1898 Wright et al. ..... 182/153
4,920,596 A * 5/1990 Stevens ..... 254/88
6,443,429 B1 * 9/2002 Hawk et al. ..... 254/90

* cited by examiner

*Primary Examiner*—Robert C. Watson

(57) ABSTRACT

A lifting device for vehicles, machines, erecting units or the like has at least one lifting element, which has at least one first mounting point and opposite this at least one second mounting point which is arranged on a load receiving section. The lifting unit and the at least one load receiving section form a first modular unit. The first modular unit has, at least one end of the load receiving section, a connecting section for receiving at least one further modular unit with at least one connecting section arranged thereon.

16 Claims, 5 Drawing Sheets

26
33
36
52
46
37
23

LIFTING DEVICE FOR VEHICLES, ERECTING UNITS, MACHINES OR THE LIKE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The invention relates to a lifting device for vehicles, erecting units, machines or the like, with at least one lifting element, which has at least one first mounting point and opposite this at least one second mounting point which is arranged on at least one load receiving section.

From a brochure of the Ravaglioli company, Bologna, Italy, an electrohydraulic shears-type lifting platform has been made known, which has a load receiver formed as a drive-on track, to be raised and lowered by means of a shears arrangement, for lifting and lowering vehicles. For raising very long vehicles, for example, it is provided that this lifting device is based on a shears arrangement with a double-cylinder drive and, depending on the length of the drive-on track, has in addition a half-shear on one or both sides of the shears arrangement. By this sequence of two half shears and a shears arrangement, lengths of the load receiver up to 16 meters can be produced. However, it is basically necessary for this purpose that this lifting device is assembled as a whole and delivered to the customer. Because of the fixed lengths of the load receivers, which have length dimensions of more than 6 m, and the associated double cylinder shears arrangement and also one or two half shears, the transportation and setting up at the customer is very time-consuming and costly.

From a brochure of the Omer company, which offers electrohydraulic parallelogram lifting platforms, it is known that the length of their load receiver reaches 7 m to 12.80 m. Depending upon the length of the load receiver, two, three, or more lifting units are provided in a row one behind the other, in order to bring the load receiver upward into a working position by means of a pivoting motion. This design likewise has the disadvantage that the parallelogram lifting platforms, which have different lengths as required by the customer, are mounted in the plant and delivered as a unit. Transportation of very long load receiving elements with a length of, for example, 12.80 m, is very costly, particularly when these lifting devices are to be transported in freight or sea containers to the destination. Furthermore, these lifting platforms have the disadvantage that the lifting units are arranged on a common base frame, which is fastened to the road surface, that is, accessibility to the working space is provided only from a narrow side.

SUMMARY OF THE INVENTION

The invention therefore has the object of providing a lifting device that is cost-effective to produce, can be easily adapted to different requirements for the length of the load receiver or the length of the drive-on tracks, and makes cost-effective transportation possible.

This object is attained by the invention wherein the lifting unit and the at least one load receiving section form a first modular unit and wherein the first modular unit has, at least one end of the load receiving section, a connecting section for receiving at least one further modular unit with at least one connecting section arranged thereon.

By means of the design of a first modular unit, which has a lifting unit and at least one load receiving section provided thereon, with at least one connecting section, it is made possible for the lifting device to be capable of modular assembly depending upon the desired total length. Thereby, flexible adaptation to different customer wishes can be easily attained. Furthermore, the modular construction gives the advantage that for example the load receiving section is provided with a length which is suitable for cost-effective transportation and for example corresponds to the size of a pallet, or a width of a sea or freight container. Thus the transportation costs, due to the possibility of dismantling the lifting device into plural components, is favorable and the handling and mounting in place are very easy.

The modular construction for forming the lifting device has the further advantage that, for example for the lifting device with a load receiver, at least two identical first modular units are provided, so that a reduction in production costs is given because of the production of modular units of identical construction.

Furthermore the modular construction has the advantage that a simple re-equipment of the lifting device is made possible when the user's requirements change, at least the first modular unit that forms the basic components of the lifting device being used again.

According to an embodiment it is provided that the lifting device is formed from two first modular units. Thereby a basic model is constituted with a basic length of the drive-on track for the lifting device, which consists of two at least substantially identical modular units.

According to a further embodiment, it is provided that the further modular unit is constituted by at least one load receiving section as a intermediate piece. This load receiving section is positioned, when there is a corresponding requirement, between the two first modular units at a length of the drive-on track exceeding the basic length. Several further intermediate pieces, with the same or different lengths or design, can also be provided between the two first modular units. Flexible adaptation and a variable construction in the total length of the drive-on tracks is thereby made possible.

It is provided that the length of the load receiving section of the further modular unit is equal to, or smaller than, that of the load receiving section of the first modular unit. The compact constructional lengths of the modules for transportation are thus retained. Furthermore, intermediate pieces, differing from the load receiving section of the first modular units, can advantageously be constituted between the first modular units. Special functions can thereby be fulfilled, or special requirements implemented, without requiring the purchase of a completely new lifting device. Rather, an exchange of the at least further modular units can be sufficient.

According to an embodiment of the invention, it is provided that the lifting unit of the first modular unit is constituted as half shears. The half shear arrangement has, for lifting and lowering, a traveling slide which is integrated with the load receiving section. Thus it is sufficient to fix the half shear at an opposite end by means of a mounting point on the floor or road surface. The working space is thus accessible from both sides and also from a narrow side of a lifting unit consisting of two lifting devices. The supply and control leads are advantageously integrated into the load receiver, so that when the lifting device is raised they do not impair accessibility to the working space on the floor. The said leads can be sectionally pre-installed in the modular units and can be connected together by means of coupling or plug connections. Alternatively, they can also be laid in or on the load receiver after assembly.

By means of the half shears, the length of the load receiving section of the first modular unit is advantageously limited by the maximum stroke, and thus by the travel path of a slide arrangement of the half shears, and can be kept small. In general, the load receiving sections have a length of 2.5–3 m, these dimensions being adaptable in dependence on the circumstances of use.

According to a further embodiment of the invention, it is provided that a flange connection is provided between the modular units along a separation plane of the load receiving sections, and has bores for releasably receiving connecting elements. Easy and rapid assembly on the spot can thereby take place. Adaptation to further circumstances of use, or the exchange of modules, is thereby easily made possible.

It is provided that the flange connection is constituted as a plate, which is arranged at right angles to the load receiving section, and has reinforcing ribs or struts between an underside of the load receiving means and the flange plate. The high loads at the separation point can thereby be reliably taken up and transferred, while maintaining easy mounting of the modular units.

According to a further embodiment, it is provided that the plate-shaped flange has a support point or at least one support surface on a side opposite the load receiving surface. This has the advantage that when a vehicle is driven on to the load receiver, additional support points are provided at the separation plane, in order to avoid a deflection of the load receiver.

BRIEF DESCRIPTION OF THE DRAWINGS

Further embodiments and developments of the invention are given in the further claims. Preferred embodiments of the invention are described in detail in the following description and accompanying drawings.

DETAILED DESCRIPTION OF THE INVENTION

Figure 1:
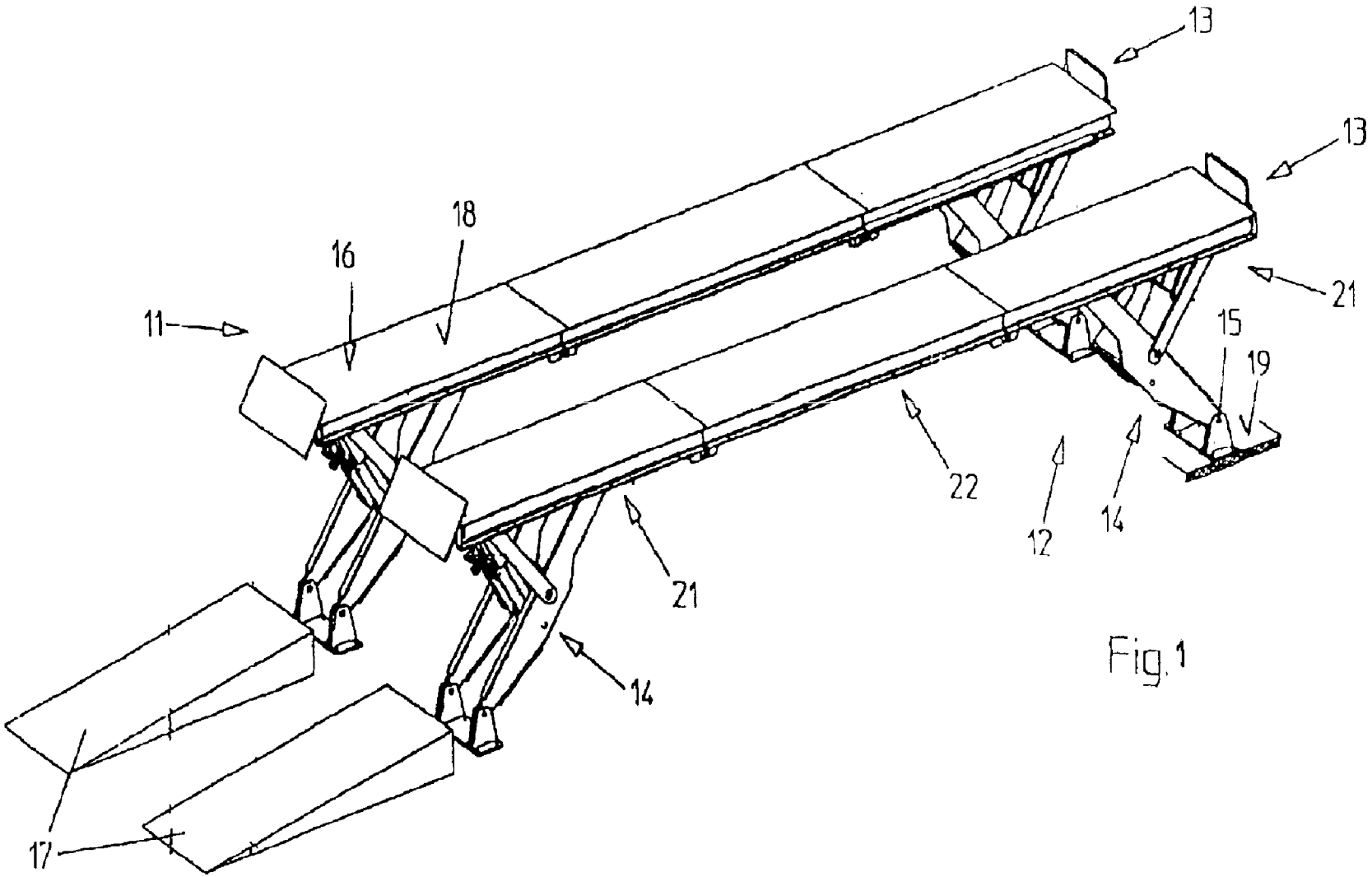
FIG. 1 shows a perspective view of a lifting unit according to the invention, in a working position.

FIG. 1 shows a perspective view of a lifting unit 11 in a working position 12. The lifting unit 11 consists of two lifting devices 13 arranged mutually parallel and spaced apart, for example, at the wheel spacing of vehicles. The lifting device 13 has a left-hand and right-hand lifting unit 14, which support a load receiver 16. The load receiver 16 is also termed a drive-on track, particularly when the lifting device 13 is used for maintenance, repair, or assembly of vehicles, commercial vehicles, transport vehicles, or the like. The load receivers 16 of the lifting device 13 are situated on the floor in an inoperative position, not shown in detail. In this position, the vehicle can travel onto the load receivers 16 on drive-on ramps 17. In this embodiment, simple mounting of the lifting devices 13 on a road surface 19 by means of a mounting point 15 is provided. Alternatively, an upper side or running surface 18 of the load receiver 16 can be provided flush with the road surface 19. The lifting device 13 is let into the road surface in this alternative embodiment, so that drive-on ramps 17 are not required.

The mounting of the lifting device directly on the road surface 19 has the advantage that the working space situated between the lifting devices 13 is easily accessible with a rolling carriage, lifting carriage, assembly carriage and the like, without steps in the road surface. In particular, this is attained in that the lifting unit 14 is mounted directly on the road surface 19 without a further base frame.

In the embodiment example, the lifting unit 14 is embodied as a so-called half shears. Such a lifting unit is known from German patent application 198 39 835.2, the content of which is completely incorporated herein by reference.

The lifting unit 14 can alternatively be formed as parallelogram elements, lifting elements, full shears, double shears, and thus two full shears arranged one above the other, or the like. In the embodiment of the lifting unit as a plunger lifting platform, it can be provided that one or two load receiving sections 23, for example spaced apart at wheel distance, are provided on the lifting plunger. When two load receiving sections 23 are provided on a lifting plunger, the lifting unit 11 is formed by two first modular units 21 and possibly modular units 22 arranged therebetween.

Figure 2:
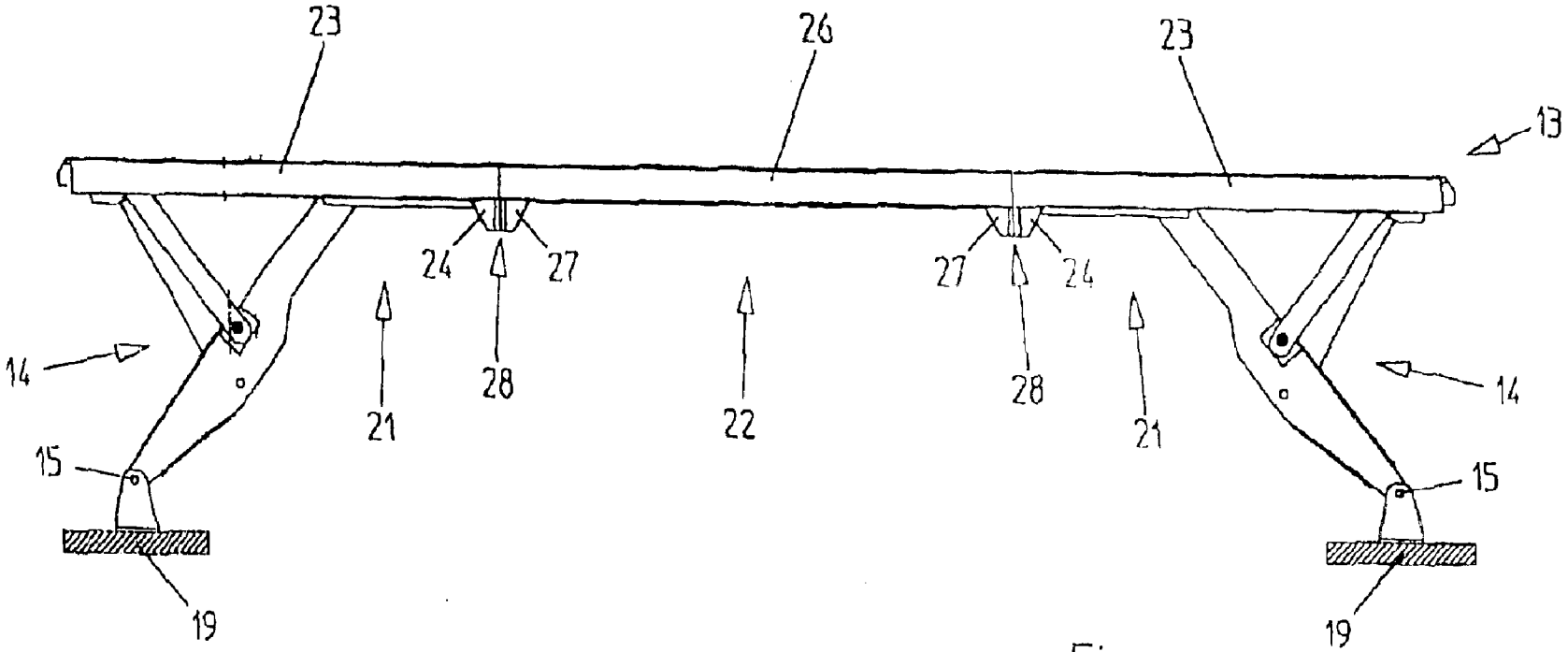
FIG. 2 shows a schematic side view of a lifting device in a working position.

The lifting device 13 is constructed of two first modular units 21 and a further modular unit 22. The first modular unit 21 includes the lifting unit 14 and the load receiving section 23 and also a connecting section 24, which is shown according to a first alternative partially in FIG. 2 and in detail in FIGS. 3 and 4, and according to a second alternative in FIGS. 5 and 6. The modular unit 22 is formed as a intermediate piece 26, with a connecting section 27 provided on its respective ends.

The lifting device 13 consists of at least two first modular units 21. Depending on the desired length of the load receiver 16, one or more further modular units 22, are arranged between the first modular units 21. The maximum length of the modular unit 22 can be limited to the length of the load receiving section 23 of the first modular unit 21. The advantage of the compact packing unit and also transportation and assembly, as well as identical components, is additionally supported.

Figure 3:
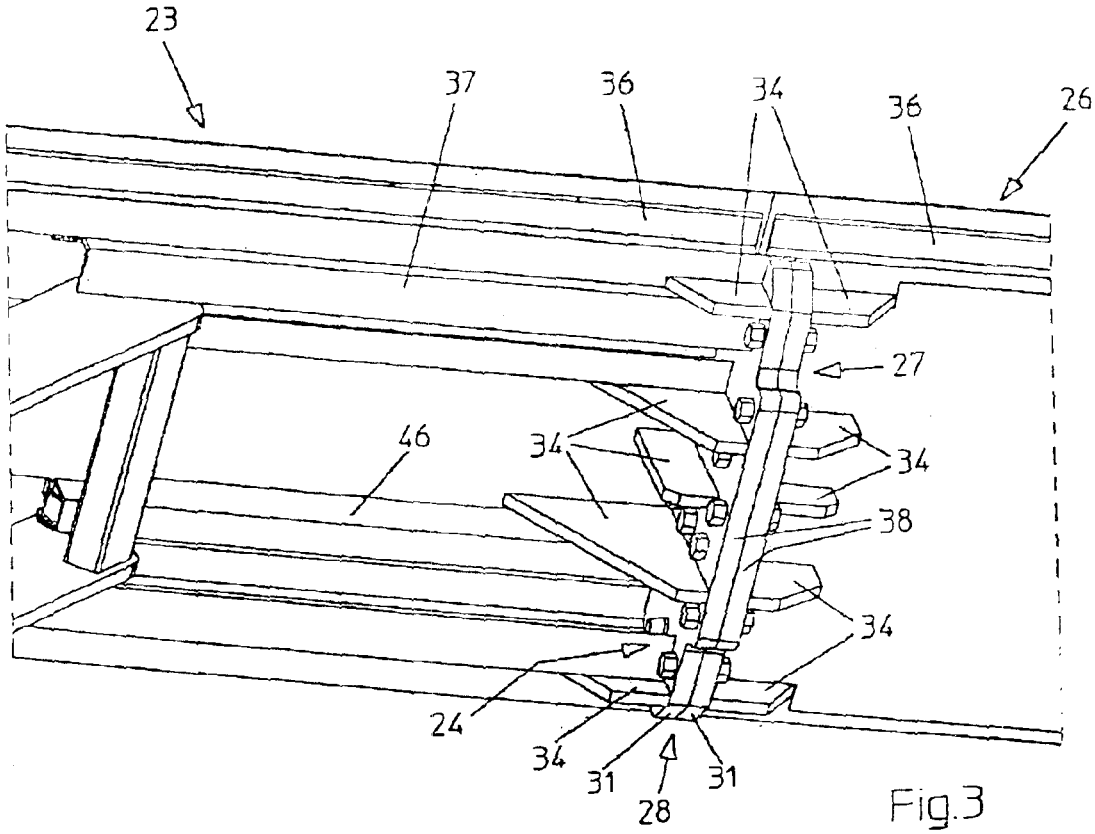
FIG. 3 shows a view obliquely from below of connecting sections of the modular units.
Figure 4:
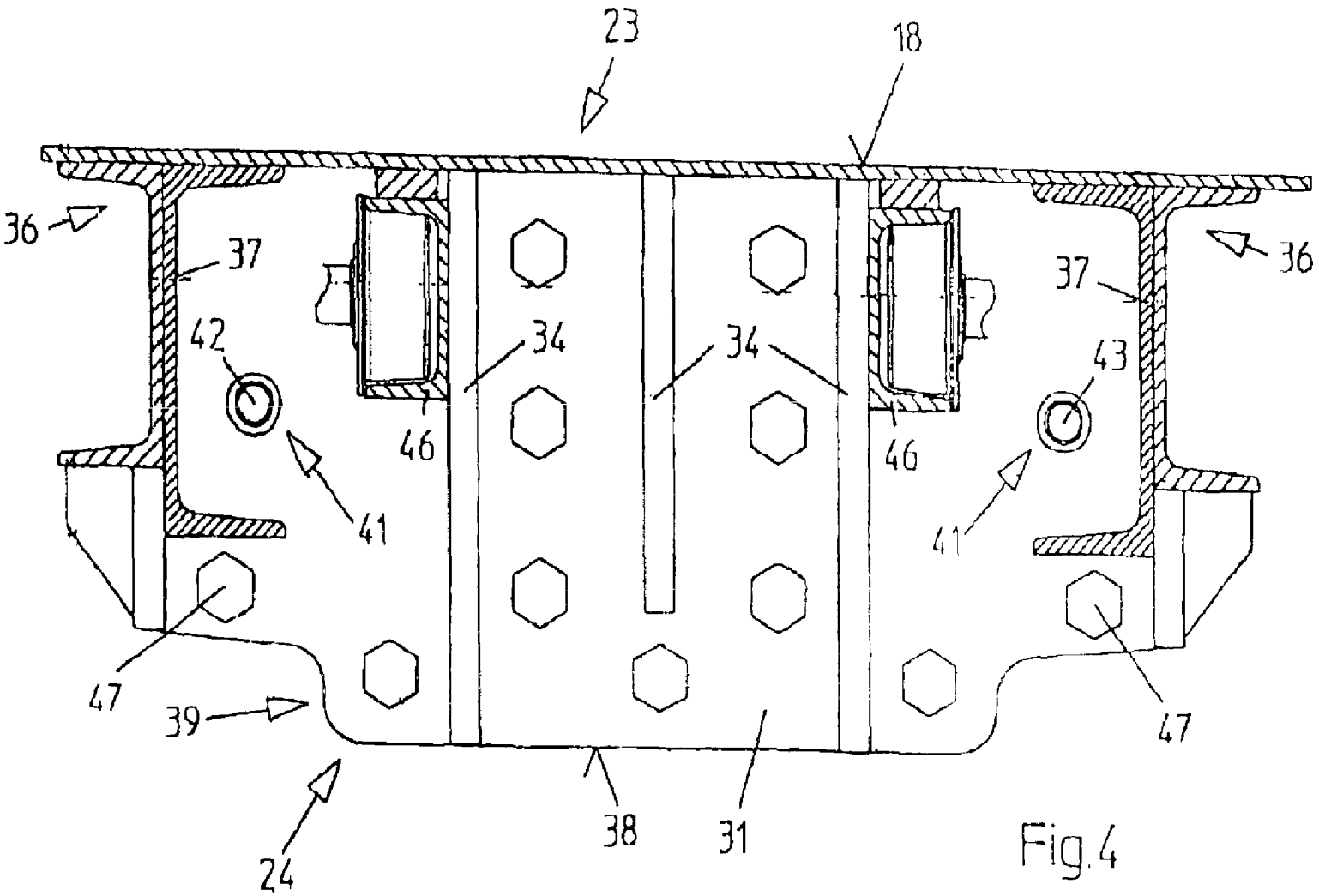
FIG. 4 shows a view of a connecting section situated in a separation plane of the modular units.

The connecting sections 24 and 27, which form a flange connection 28, is shown in detail in FIGS. 3 and 4. The connecting sections 24 and 27 are formed as plates, the connection surfaces of which are at least partially situated in a separation plane 33 which runs at right angles to the running surface 18 of the load receiver 16. The plate 31 is held by reinforcing ribs 34 which engage on the underside of the load receiving section 23. The plate 31 is furthermore fixed to C-shaped profiles 36. These C-shaped profiles 36 are open outward and form a rail for a running carriage or axle free lifter. Furthermore, for example, C-shaped profiles 37 are provided on the load receiving section 23 and on the one hand serve to reinforce the first modular unit 21 and on the other hand reinforce the plate 31.

The plate 31 has support points 38, or respectively a support surface, which is opposite the running surface 18 of the load receiver 23. This is formed at a height so as to give a horizontal alignment of the load receiving section 23 in the inoperative position. At least one of the reinforcing ribs 34 extends as far as the support point(s) 38 or support surfaces 38. At the same time, a row of bores 39 is provided near the support points 38 and serves to receive a screw connection in order to produce the flange connection 28. The stiffening and the connection are of particular importance in this edge region, since in this region the greatest forces arise when there is a bending stress of the load receiver 16.

The joint faces of the connecting sections 24, 27 furthermore have centering elements 41, for example a centering pin 42 and centering bore 43 are provided on a connecting section 24, with a corresponding structure provided on the connecting section 27. The centering elements 41 serve on the one hand to align the abutment location with respect to the upper side 18 of the load receiver 16 and on the other hand for flush lining up of the C-shaped profiles 36. The connecting sections 24, 27 are mutually matched so that a positive and frictional connection is made possible.

Quick and easy assembly and also exchange of components can be given, for example, by the releasable screw connection provided for fastening the two connecting plates 24, 27. The reinforcing ribs 34 of the connecting section 24 and of the connecting section 27 are preferably arranged mutually aligned, so that in spite of a separation point a nearly undisturbed force flux is made possible.

For reinforcing the plate 31, a guide rail 46 of the shears arrangement 44 is moreover provided. This guide rail 46 is not only connected to the junction plate 31 but also to the load receiver 23 and preferably to a reinforcing rib 34, so that a diagonal stiffening results. The C-shaped profiles 37 are arranged at a distance from the longitudinal mid-axis of the load receiver 23 and make possible, in connection with the series of bores 39 and the bores 47 bordering on them, a rotationally secured arrangement of the load receiving section 23 and of the intermediate piece 26. The centering elements 41 also have a supporting action for this purpose.

Figures 5, 6:
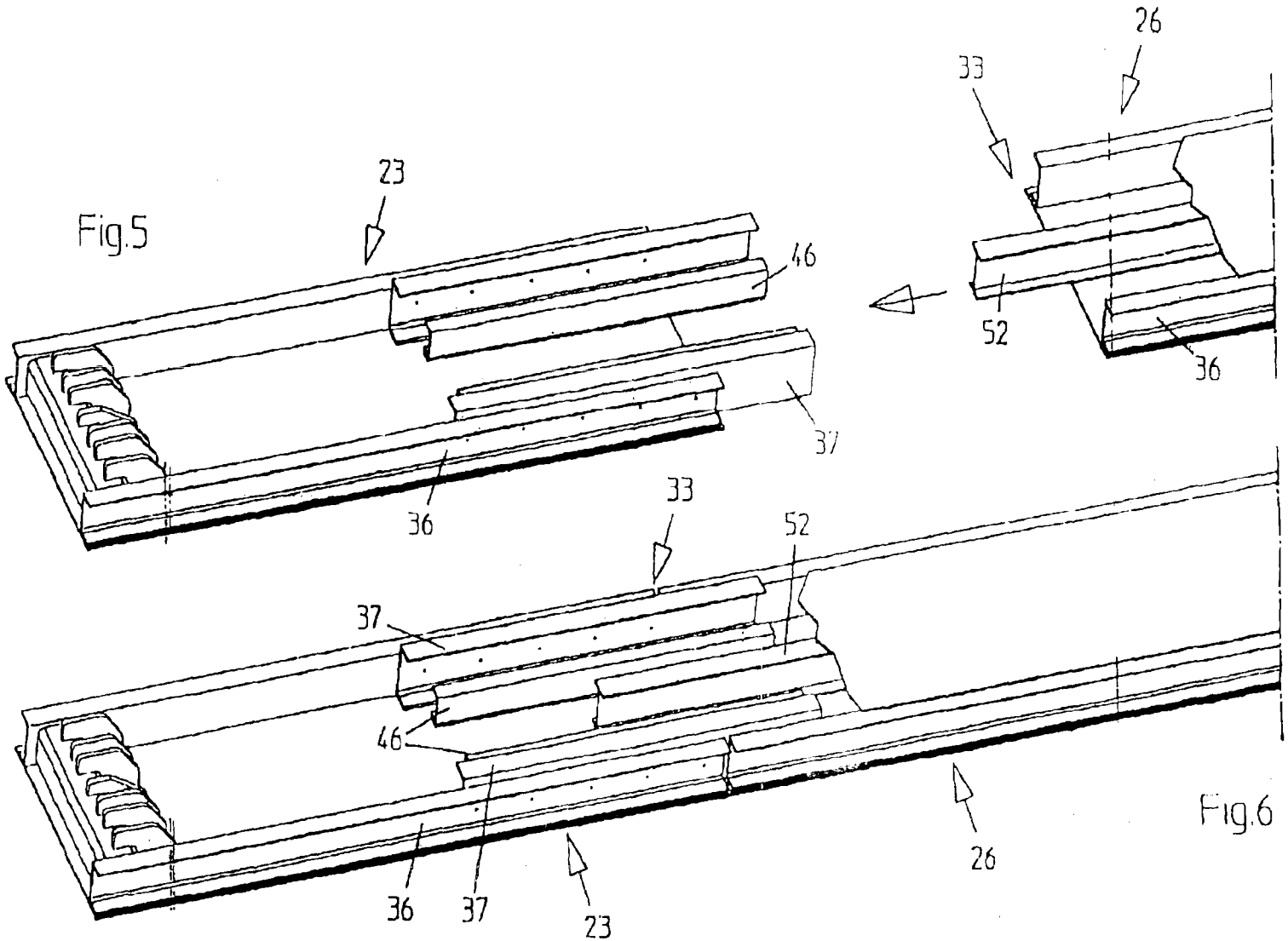
FIG. 5 shows a perspective view from above of the underside of load receiving sections with an alternative flange connection.
FIG. 6 shows a perspective view from above of the underside of load receiving sections according to FIG. 5, in a mounted state.

An alternative embodiment of a flange connection 28 is shown in FIGS. 5 and 6. This flange connection 28, in contrast to the flange connection shown in FIGS. 3 and 4, has the principle that fastening elements such as, for example, C-shaped beams or the like retaining elements are provided, engage over the separation plane 33, and engage both in the first modular unit 21 and also a further modular unit 22. The C-shaped profiles 37 project out to a given extent over the separation plane 33, so as to engage beneath the running surfaces of the intermediate piece 26. A retaining element or support 52 is provided on the intermediate piece 26, for example in the longitudinal mid-axis, and engages on the underside of the load receiving section 23. The profiles 46 which form the guide of the slide arrangement of the half shears can furthermore be formed elongated and can supportingly engage on the opposite modular unit. The profiles 37, 46, 52 are fixed together by screw-clamp connections.

An assembled arrangement of a first and a further modular unit 21, 22 is shown in FIG. 6. Further fastening elements or principles, not shown or described in detail, can likewise be used and provided.

Alternatively, a combination of the flange connection shown in FIGS. 3 and 4 and also in FIGS. 5 and 6 can be provided. Further alternative embodiments are likewise possible. The requirements on a flange connection 28 include a nearly closed force flux over the connection place, a centering of the running surface 18 of the load receiver 16 and also of the C-shaped profiles 36, where present, and also a securement against relative mutual rotation of the module units 21, 22.

For forming a lifting unit 11, according to the modular structure of the invention four first modular units 21 are required, preferably of identical construction, and are supplemented by at least one further modular init 22 per lifting device 13, depending on the total length. The compact construction and the low number of different component parts make a cost saving possible. Moreover, the constitution of the lifting device 13 by two lifting units 14, which operate under common control and mechanically independent from one another, is statitcally determined, so that a reliable lifting device 13, versatile in use, is provided.

I claim:

1. Lifting device for vehicles, machines, erecting units or the like, comprising at least one lifting element (14), which has at least one first mounting point (15) and opposite this at least one second mounting point which is arranged on at least one load receiving section (23), wherein the lifting unit (14) and the at least one load receiving section (23) form a first modular unit (21); and wherein the first modular unit (21) has, at least one end of the load receiving section (23), a connecting section (24) for receiving at least one further modular unit (21, 22) with at least one connecting section (24, 27) arranged thereon.

2. Lifting device according to claim 1, wherein the further modular unit (21) is formed substantially identically to the first modular unit (21).

3. Lifting device according to claim 1, wherein the at least one further modular unit (22) comprises an intermediate piece (26) for receiving a load, having two connecting sections (27).

4. Lifting device according to claim 3, wherein the length of the intermediate piece (26) of the further modular unit (22) is equal to or smaller than that of the load receiving section (23) of the first modular unit (21).

5. Lifting device according to claim 1, wherein the lifting element (14) of the first modular unit (21) is a half shears and at least two first modular units (21) are provided for forming a lifting device (13).

6. Lifting device according to claim 5, wherein the at least two first modular units (21) are arranged mirror-imagewise of one another.

7. Lifting device according to claim 1, wherein the connecting sections (24, 27) are connected together at least one of positively and frictionally.

8. Lifting device according to claim 1, wherein a flange connection (28) is provided along a separation plane (33) between the modular units (21, 22), and has bores for releasably receiving connecting elements.

9. Lifting device according to claim 8, wherein the flange connection (28) is arranged as a plate (31) at right angles to the load receiving section (23).

10. Lifting device according to claim 9, wherein the flange connection (28) is supported by reinforcing ribs (34) on an underside of the load receiving section (23).

11. Lifting device according to claim 1, wherein the connecting sections (24, 27) have at least one support point (38) or at least one support surface, opposite an upper side (18) of the load receiver (16).

12. Lifting device according to claim 11, wherein the at least one support point (38) or the at least one support surface is spaced apart from the upper side (18) of the load receiving device (16) such that the load receiver (16) in an inoperative position is arranged running horizontally and is arranged supported on a road surface (19).

13. Lifting device according to claim 7, wherein bores (39, 47) for connecting elements are provided at least in outer edge fibers of the connecting sections (24, 27).

14. Lifting device according to claim 1, wherein fastening elements (37, 46, 52) are provided on an underside of the load receiving sections (23), and extend at least partially beyond the separation plane (33) and engage on the respective opposite load receiving section (23) or on the intermediate piece (26).

15. Lifting device according to claim 14, wherein profiles (37) which are provided for receiving a movable slide of the lifting unit (14) extend over the separation plane (33).

16. Lifting device according to claim 1, wherein each connecting section (24, 27) has centering elements (41) for aligning the modular elements (21, 22).

* * * * *